US005673803A

United States Patent [19]

Burback

[11] Patent Number: 5,673,803

[45] Date of Patent: Oct. 7, 1997

[54] PEG BOARD SYSTEM

[76] Inventor: Ronald E. Burback, 687 Hampton, Alliance, Nebr. 69301

[21] Appl. No.: 423,371

[22] Filed: Apr. 18, 1995

[51] Int. Cl.[6] ..... A47F 5/08

[52] U.S. Cl. ..... 211/87; 248/220.31; 248/220.43; 248/220.42

[58] Field of Search ..... 211/87, 57.1, 59.1; 248/220.21, 220.31, 220.41, 220.42, 220.43, 221.11, 222.11, 224.61, 225.21; 40/657

[56] References Cited

U.S. PATENT DOCUMENTS

| | | | |
|---|---|---|---|
| 2,127,230 | 8/1938 | Moineau | 248/222.11 |
| 2,965,235 | 12/1960 | Daline | 211/87 X |
| 3,193,231 | 7/1965 | Curry | 248/220.42 |
| 3,264,462 | 8/1966 | Haggstrom | 40/657 X |
| 3,352,428 | 11/1967 | Sak et al. | 211/87 |
| 3,423,055 | 1/1969 | Fisher | 248/222.11 X |
| 3,625,464 | 12/1971 | Conran | 248/220.43 |
| 4,509,648 | 4/1985 | Govang et al. | 211/59.1 X |
| 5,138,803 | 8/1992 | Grossen | 248/220.31 X |

FOREIGN PATENT DOCUMENTS

| | | | |
|---|---|---|---|
| 1049478 | 2/1979 | Canada | 248/220.43 |
| 8300133 | 1/1983 | WIPO | 211/87 |

*Primary Examiner*—Leslie A. Braun
*Assistant Examiner*—Sandra Snapp
*Attorney, Agent, or Firm*—Chase & Yakimo

[57] ABSTRACT

A peg board system presents a plastic panel having a plurality of peg receiving holes and fastener receiving holes therein. The fastener receiving holes are spaced at selected lateral distances, e.g. 16 inch centers, so as to align the fastener holes with the wall studs. Spacers displace the fastened panel from the wall. The peg receiving apertures are tapered to receive pegs of a similar configuration in a friction fit relationship therein. At one end of each peg is a resilient bulb for extension from the rear of the hole with a disk at the opposed peg end for attachment to various devices. The bulb precludes the peg from sliding out the hole and cooperates with the shank to securely and releasably engage each peg with each tapered hole. Various items may be fastened to the pegs so as to be supported from the peg board upon peg insertion into selected peg receiving apertures.

8 Claims, 10 Drawing Sheets

PEG BOARD SYSTEM

BACKGROUND OF THE INVENTION

This invention relates to a wall hanging system and, more particularly, to a peg beard system for attachment to a wall so as to support various devices therefrom.

The use of a composition board having a plurality of spaced-apart holes for receiving tool-supporting hangers therein is known. Such boards are usually designed for use in workshops, garages, etc., and thus are particularly designed to hang various types of tools therefrom.

One problem with such boards is that they are not designed for use within a house so as to display devices other than tools in bedrooms, kitchens and the like. Also, the previous boards did not present structure to securely attach the peg board to the wall studs. It is also desirable to not only securely attach the peg board to the appropriate wall studs but also to provide support pegs which are firmly and releasably secured to the peg board.

In response thereto I provide a plastic peg board having a plurality of tapered peg holes therein. The board has a plurality of apertures surrounded by spacers with the apertures directing wall fasteners therethrough. The spacers are positioned to align the fasteners with wall studs as well as to displace the board away from the wall proper. Pegs having a tapered shank with a resilient bulb at the distal end thereof are releasably engageable with the tapered peg board holes. At the proximal end of each peg is a disk for attachment to devices such as shelves, hooks, etc. The peg board can be fastened to the wall at various positions so as to enable the board to be utilized by users of various stature.

It is therefore a general object of this invention to provide a peg board system which is easily aligned with wall studs for affixation to a wall or the like.

Still another object of this invention is to provide a peg board system, as aforesaid, which is made of a decorative material.

Another particular object of this invention is to provide a peg board system, as aforesaid, which uses a plurality of apertures surrounded by spacers to align the apertures with wall studs and to displace the mounted peg board away from the wall so as to facilitate subsequent peg use.

Another object of this invention is to provide a peg board system, as aforesaid, which utilizes a plurality of pegs configured to releasably fit into corresponding peg board apertures.

Another object of this invention is to provide a peg board system with pegs, as aforesaid, which supports various devices.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
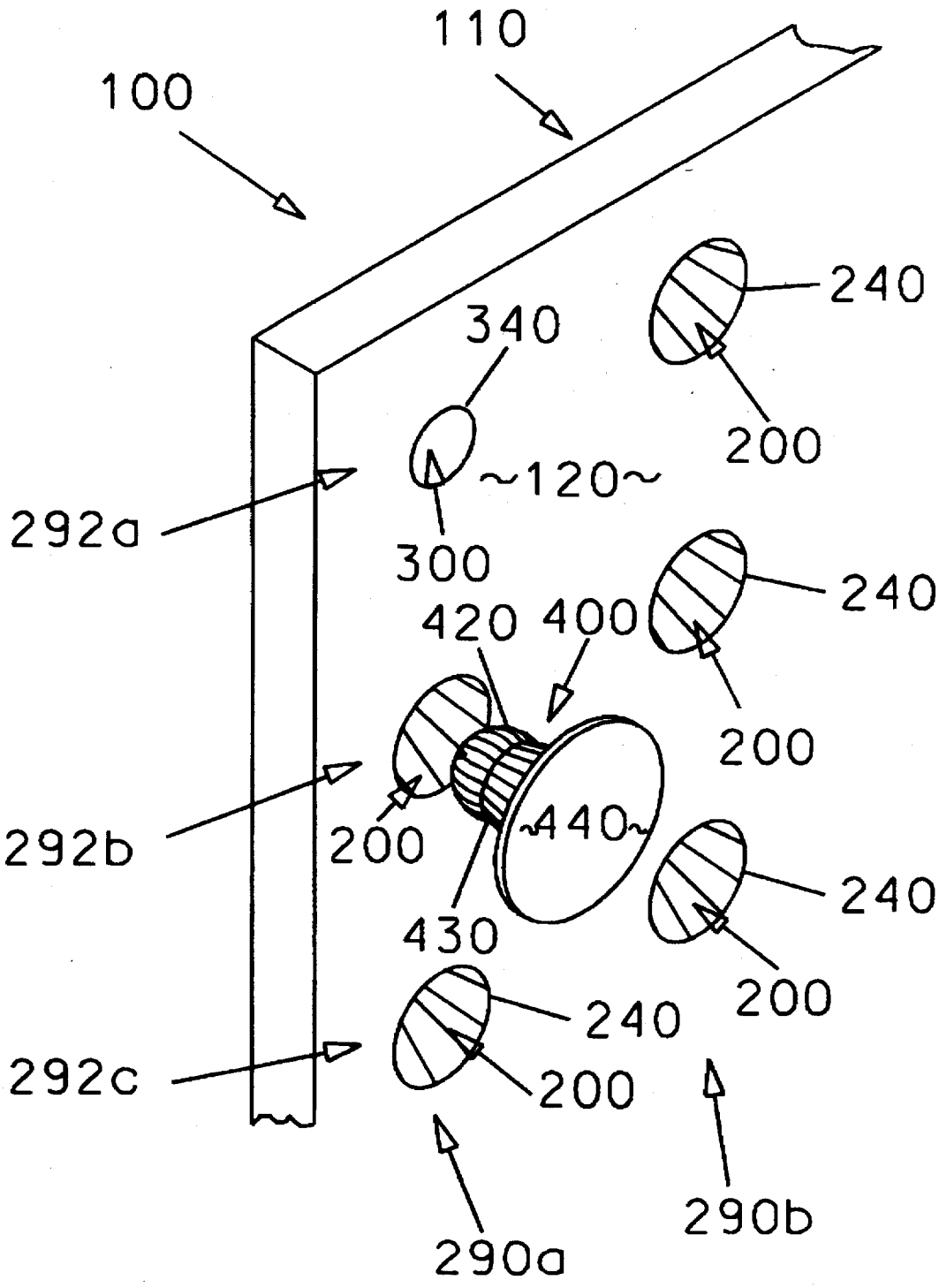
FIG. 1 is a front perspective view, on a fragmentary scale, showing one of the pegs exploded from one corner of the peg board.
Figure 2:
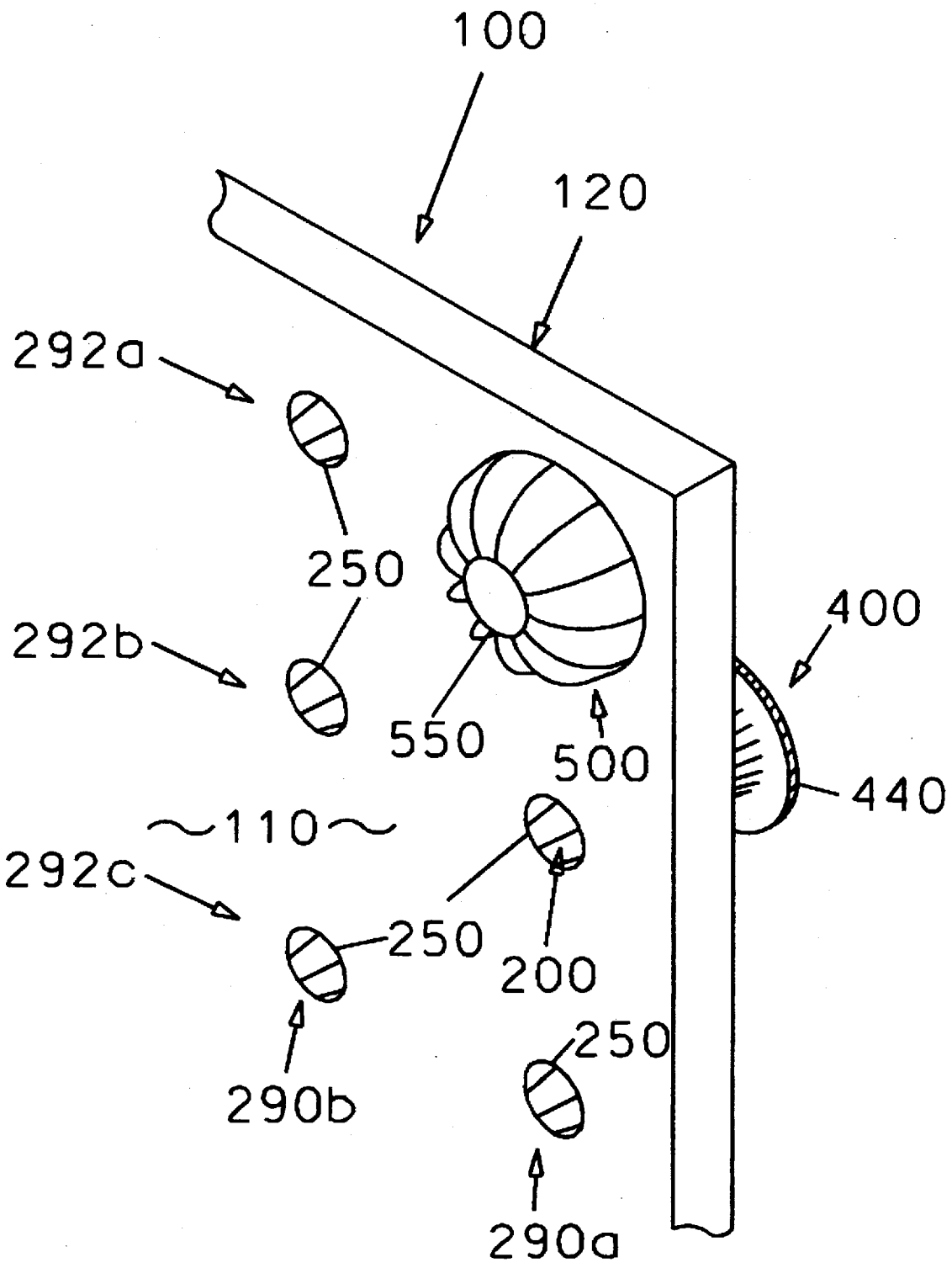
FIG. 2 is a rear view of the peg board of FIG. 1 and showing a spacer on the rear surface thereof.
Figure 3:
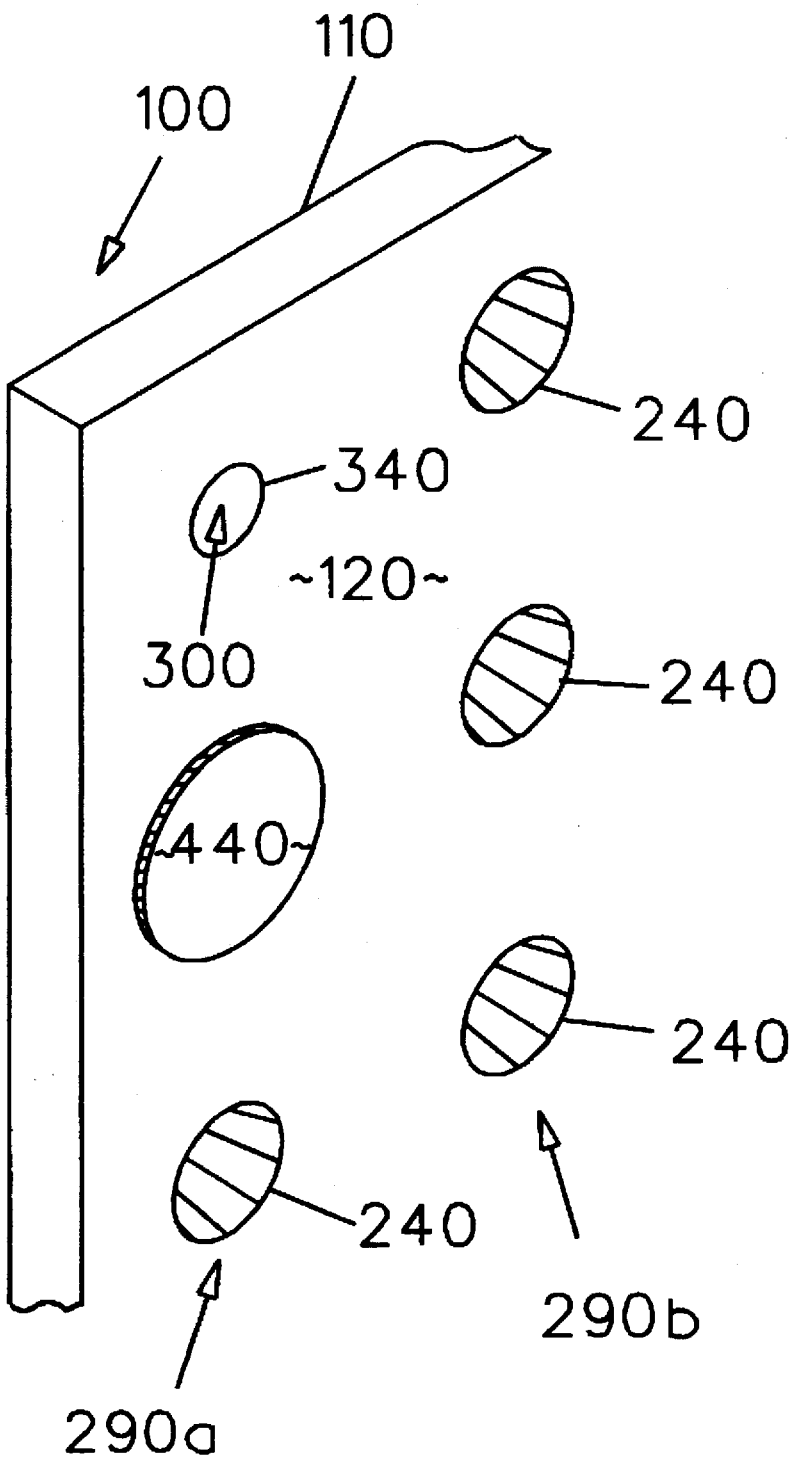
FIG. 3 is a perspective view, as in FIG. 1 showing the peg releasably secured to the peg board.
Figure 4:
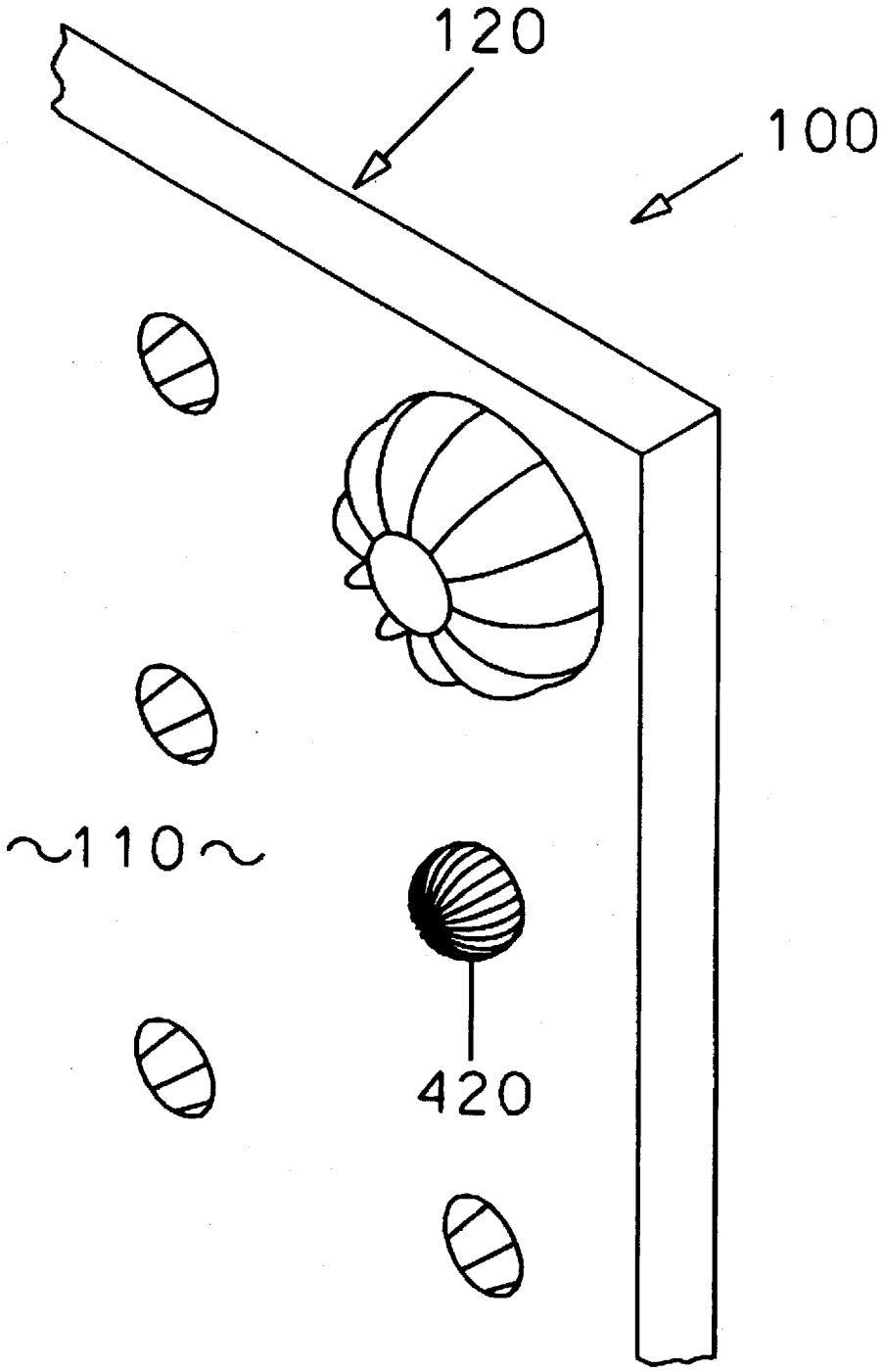
FIG. 4 is a rear view of the peg board of FIG. 3.
Figure 5:
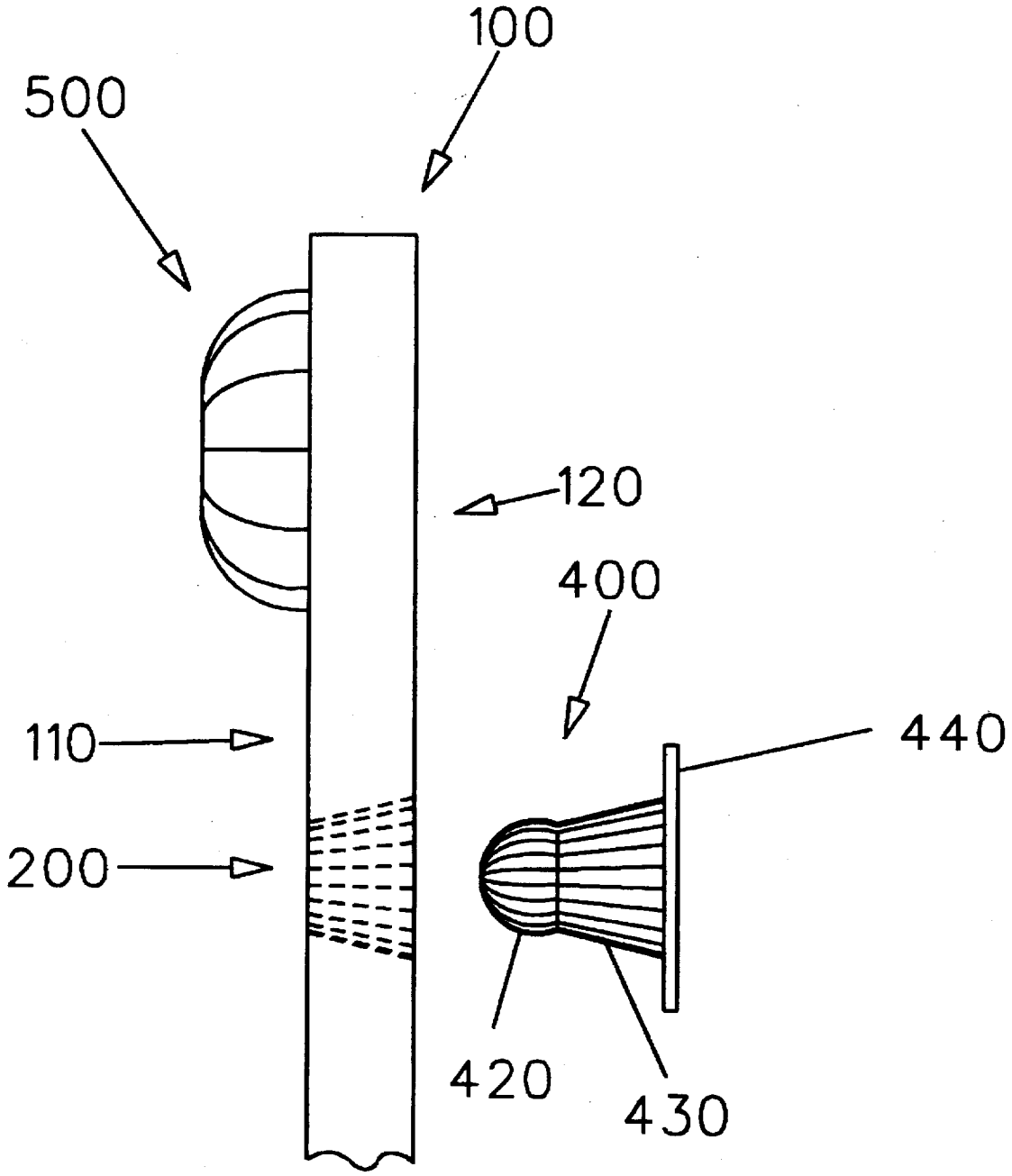
FIG. 5 is a side view of the peg board of FIG. 1.
Figure 6:
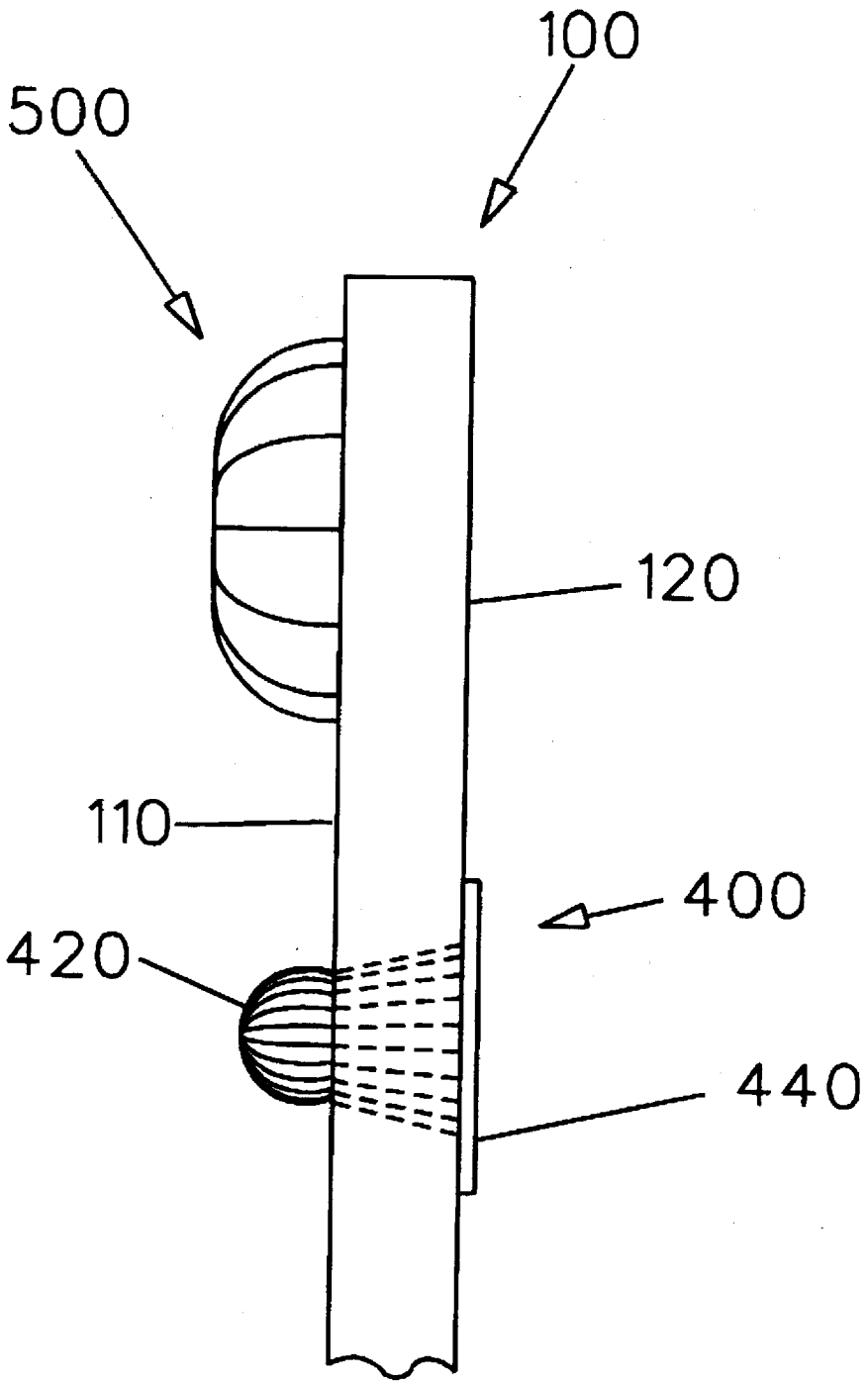
FIG. 6 is a side view of the peg board of FIG. 2.
Figure 7:
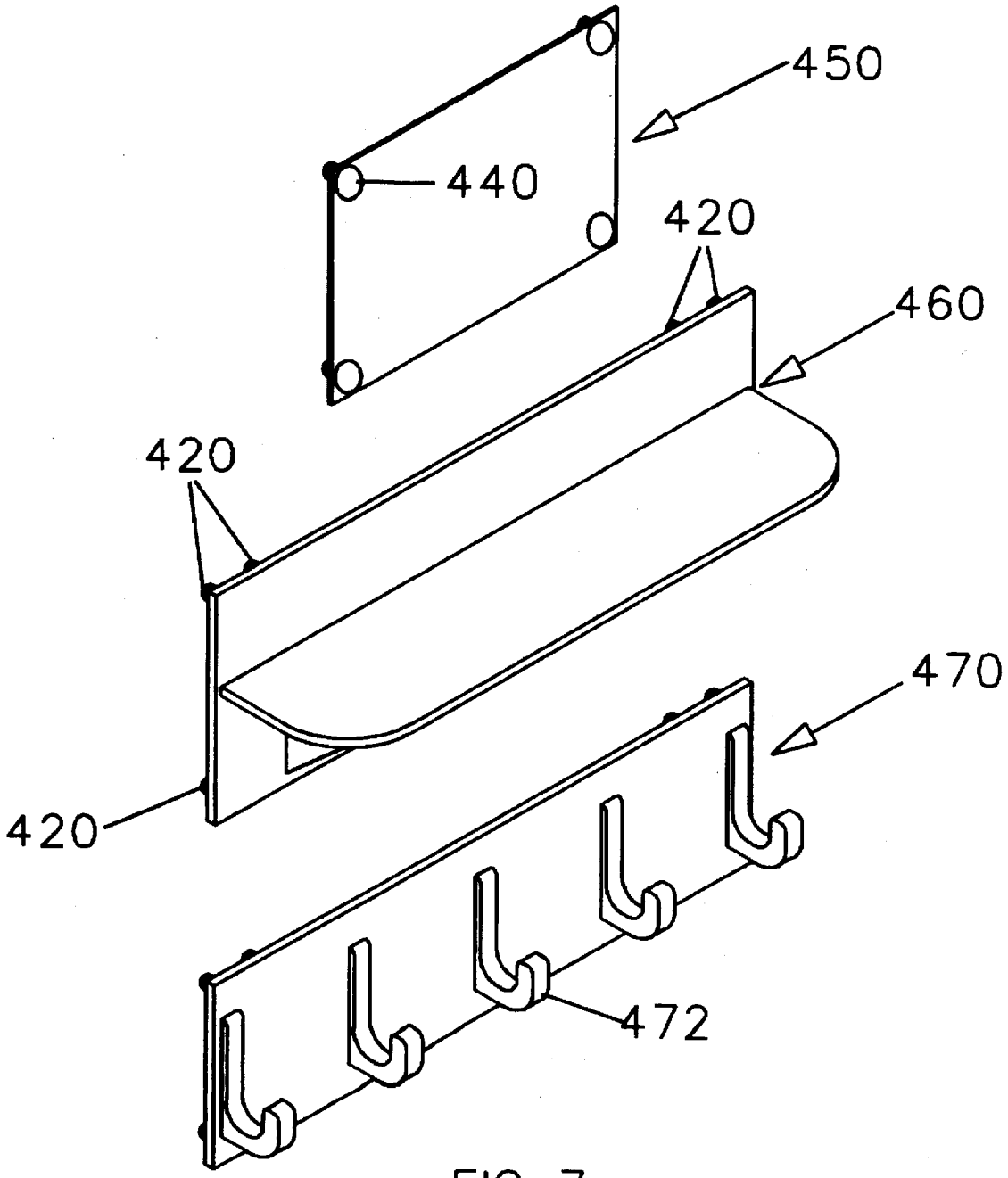
FIG. 7 is a perspective view showing a plurality of devices which can be attached to the pegs of the peg board system.

Turning more particularly to the drawings, FIG. 1 illustrates a corner of a peg board panel 100 designed to be attached to a wall surface or the like. The panel 100 generally comprises rear 110 and front 120 planar surfaces having a plurality of bores 200, 300 therethrough. The bores 200, 300 appear in a plurality of aligned vertical 290*a*, 290*b*, etc. and horizontal 292*a*, 292*b*, 292*c*, etc., rows throughout the panel 100. The bores 300 only appear in vertical rows on 16 inch centers as measured from the first vertical row 290*a*. Such bores 300 preferably appear at the top (shown) and bottom of the vertical row but do not appear throughout the particular vertical row.

The bores 200 present a plurality of apertures 240 on the front panel 120 thereof. On the opposed rear surface 110 of panel 100 are located the opposed apertures 250 of the bore 200. As the bore 200 is tapered in its extension between the front panel 120 aperture 240 and rear panel 110 aperture 250, the aperture 250 of each bore 200 is of a reduced diameter relative to the opposed aperture 240.

Bores 200 are designed to receive pegs 400 therethrough. Each peg 400 comprises a resilient bulb 420, a tapered shank 430 and a generally flat disk 440 at the end of shank 430. The bulb 420 is configured so that upon insertion into the bore 200 it will be gradually compressed by the bore's 200 taper to allow for extension through the rear surface 110 aperture 250. The length of shank 430 positions the disk 440 adjacent the front surface 120 when the bulb 420 projects past the bore 200 aperture 250. The configuration of shank 430 is reduced relative to the tapered configuration of the bore 200 such that shank 430 fits in a snug/friction fit relationship within the bore 200. It is understood that the bulb 420 precludes longitudinal displacement of the peg 400 from the bore 200. Thus, the peg 400 remains in place within bore 200 absent a sufficient force being exerted on the disk 440 so as to remove the peg 400 from its appropriate bore 200.

Figure 8:
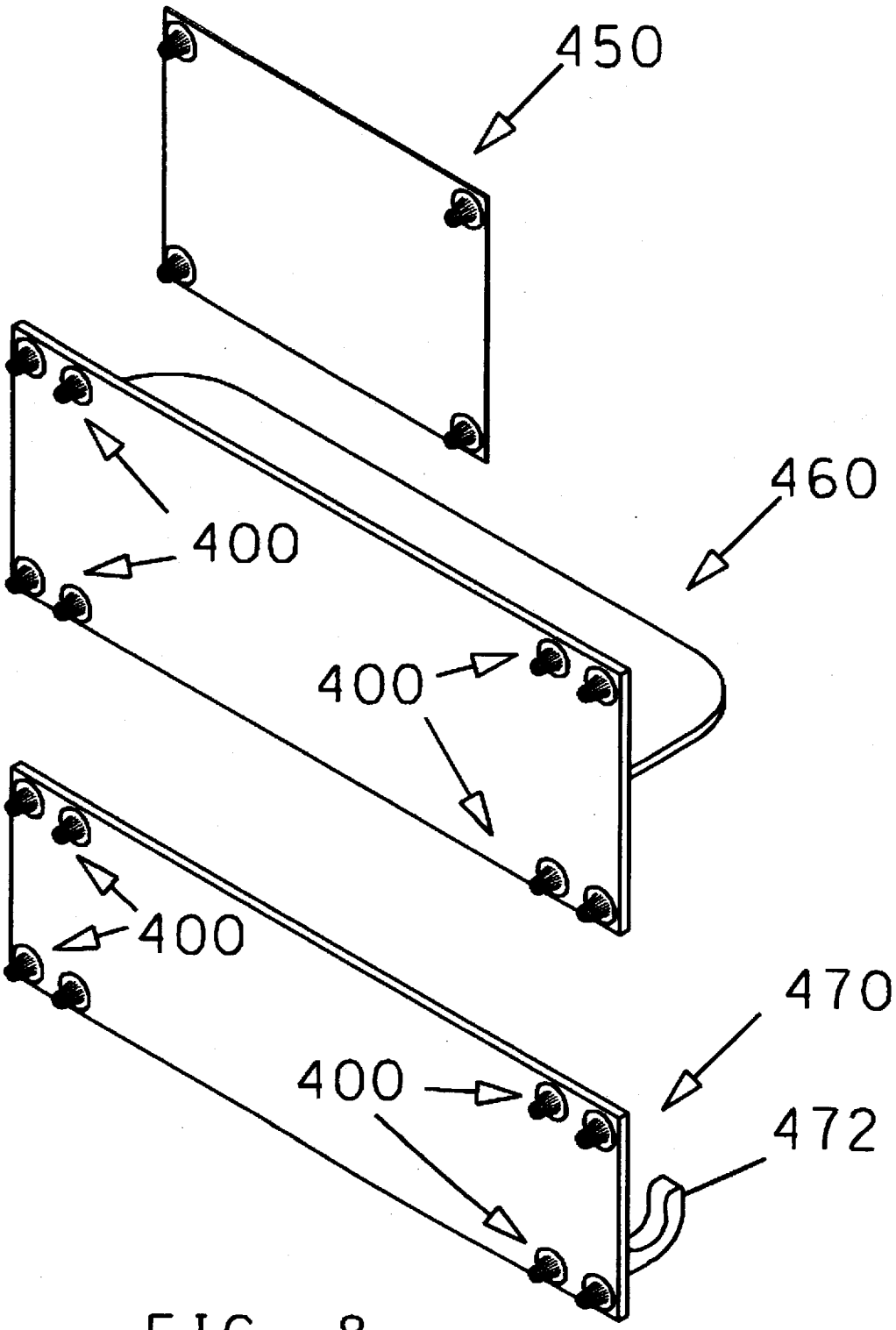
FIG. 8 is a rear view of the devices of FIG. 7.
Figure 9:
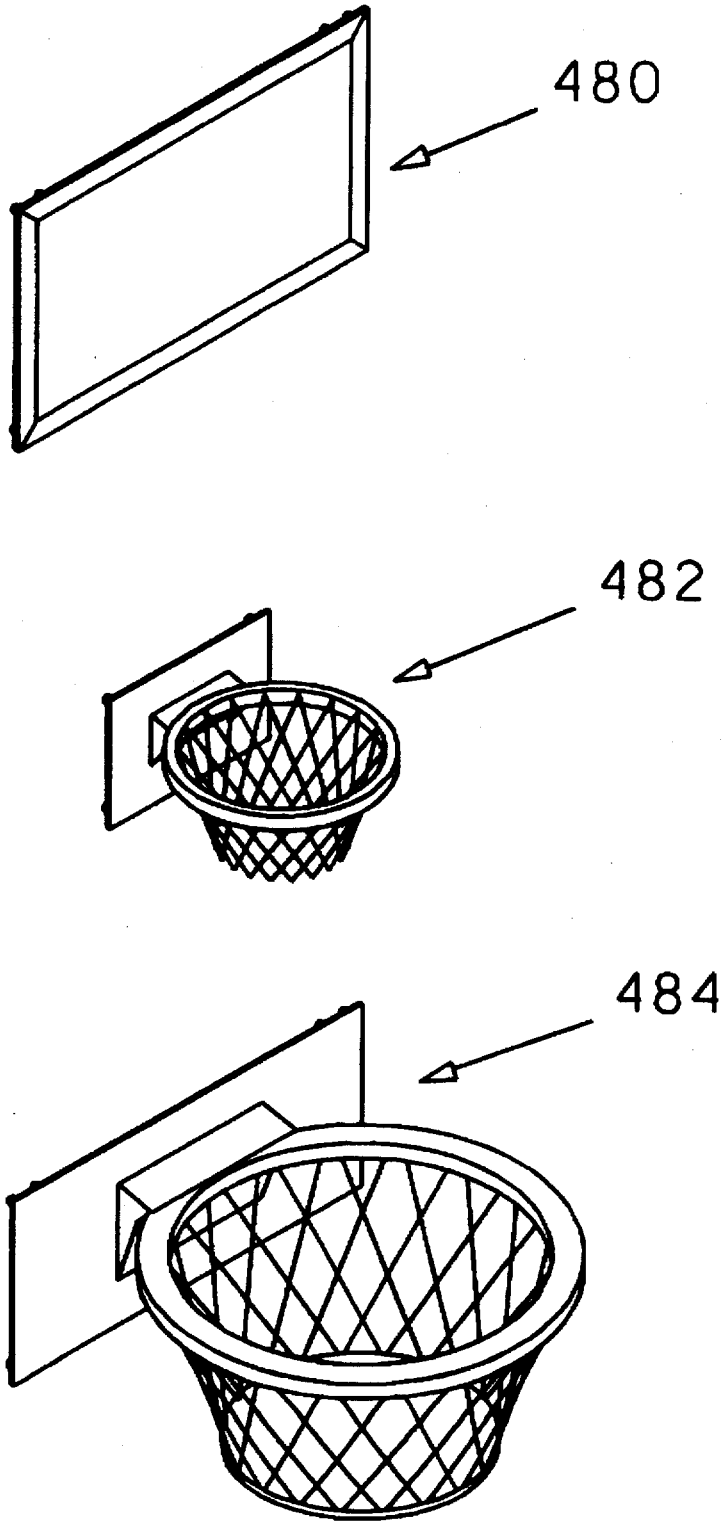
FIG. 9 is a perspective view showing additional devices which can be combined with the pegs of the peg board system.
Figure 10:
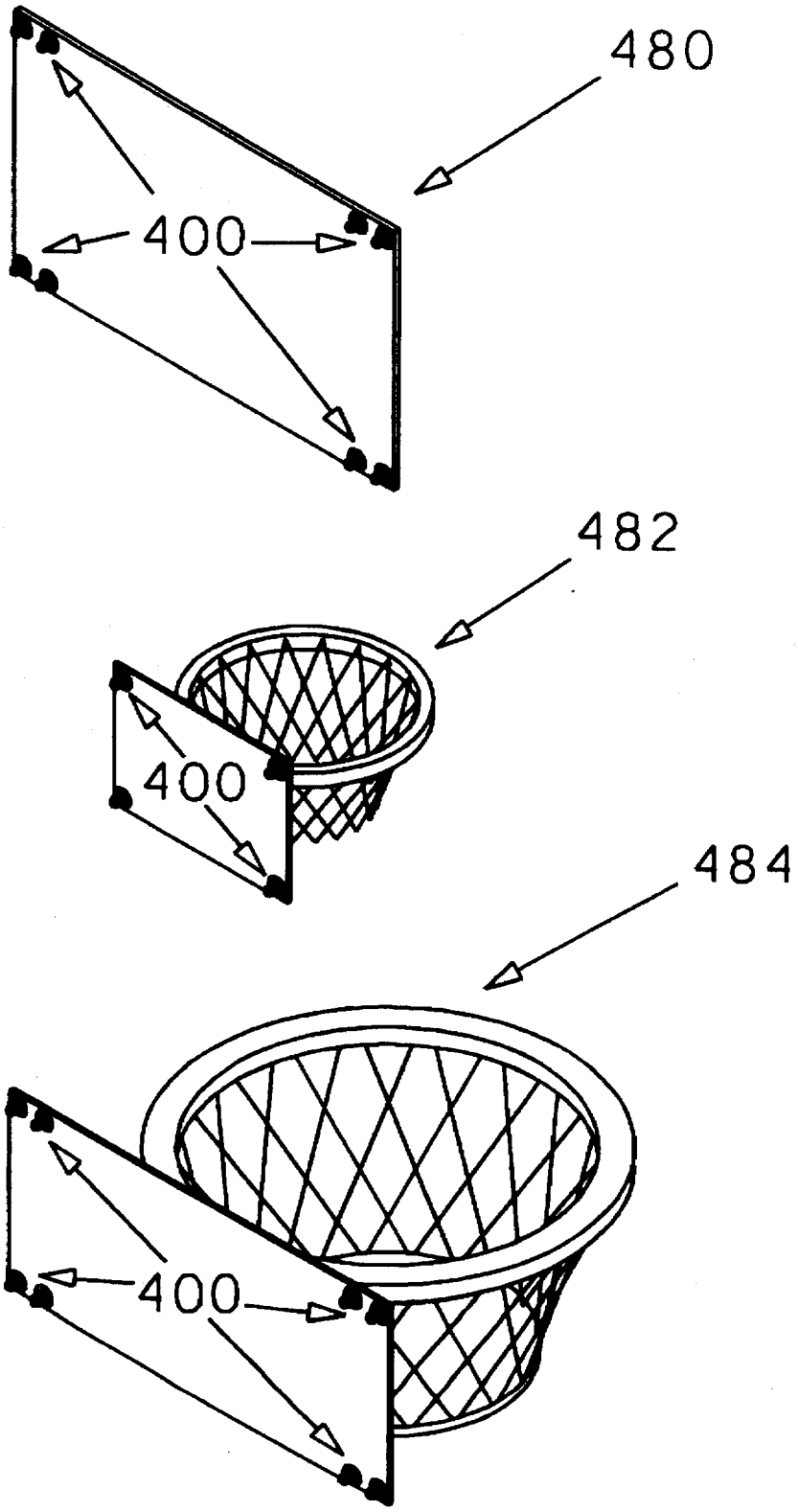
FIG. 10 is a rear view of the devices of FIG. 9.

The disk 440 is combined with another device such as the PLEXIGLAS® sheet 450, shelf 460, panel 470 with hooks 472 as shown in FIG. 8 or the bulletin board 480, basketball goal 482 or laundry basket 484 as shown in FIG. 9. As such, the PLEXIGLAS® sheet 450 will press a picture, poster, painting, etc. against the panel 100 surface 120 upon insertion of the attached peg 400 into a bore 200. It is understood that a plurality of pegs 400 are attached to such items depending on the dimensions and/or weight of the item. The pegs 400 are thus positioned along the rear of the respective item in a spatial relationship conforming to the spatial relationship of bores 200 in the peg board panel 100.

As above stated, a plurality of bores 300 are also positioned in selected vertical rows 290*a*, etc. appearing at 16 inch centers. These bores 300 are to receive fasteners (not shown) therethrough for attachment of the panel 100 to wall studs or the like. Surrounding the aperture of each bore 300 on the rear panel are spacers 500. The spacer 500 presents a bore 550 which is aligned with the bore 300. As such a wall fastener is extended through the aligned bores 300, 550 for engagement with the wall studs. Again, it is understood that such spacers 500 are in vertical rows on 40.64 cm/16 inch centers and are spaced throughout each row. Upon attachment of the fasteners to the wall studs, the spacer 500 displaces the panel 100 from the wall. As such, this spatial relationship between the panel 100 and the wall allows for extension of bulb 420 through the rear aperture 250 of the panel 100.

Once attached the various devices as shown in FIGS. 7, 8, 9 and 10 may be releasably engaged with the panel 100 via extension of the attached pegs 400 through the respective apertures. As a plurality of bores 200 are presented throughout the panel 100 the devices may be placed on the panel 100 at a plurality of selectable positions thereon upon insertion of the pegs 400 into the appropriate bores 200.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A peg board system comprising:

a planar panel having first and second opposed planar surfaces;

a plurality of first spaced-apart bores extending through said panel, each bore presenting apertures on said opposed surfaces of said panel, said first bores presenting a tapered configuration wherein said aperture on said first surface of said panel is greater than said opposed aperture, on said opposed second surface;

a peg for insertion into said first bores, each peg comprising:

a resilient bulb at a distal end of said peg, said bulb having a first normal mode wherein a circumference of said bulb is less than a circumference of said aperture on said first surface and greater than a circumference of said aperture on said second surface, said resilient bulb being successively increasingly compressed upon passage of said bulb through said tapered bore between said first surface aperture and second surface aperture, said compressed bulb returning to said normal mode upon passage through said second surface aperture, said bulb returning to said normal mode and against said second surface upon said passage through said second surface aperture;

a tapered shank extending from said bulb, said shank having a reduced configuration adapted for a friction fit within said first bore taper upon said passage of said bulb through said second surface aperture;

a disk at an opposed end of said tapered shank, said disk positioned adjacent said first surface of said panel upon insertion of said peg in said selected first bore with said resilient bulb positioned against the opposed second surface, said disk attached to a device to be supported by said peg upon insertion in said first bore, said bulb in said normal mode against said second panel surface cooperating with said friction fit of said shank in said first bore to retain said respective peg in said first bore.

2. The system as claimed in claim 1 further comprising a plurality of second bores extending through said panel, said second bores being laterally displaced along said panel at preselected distances, said second bores presenting first and second opposed apertures for insertion of a fastener through said panel and into an adjacent wall.

3. The system as claimed in claim 2 wherein said second bores are laterally displaced along said panel at distances corresponding to a distance between spaced-apart studs of a wall.

4. The system as claimed in claim 2 further comprising a spacer on said second planar surface surrounding said second aperture of said second bore for displacing said panel from the wall.

5. The system as claimed in claim 1 wherein said first bores are extended throughout said panel in vertical and horizontal alignment therebetween.

6. The system as claimed in claim 1 wherein said disk is molded with a device to be supported by said peg upon insertion in said first bore.

7. The system as claimed in claim 1 wherein the device is a clear panel attached to said disk, said panel pressing an item against said first surface upon said insertion of said attached peg in said first bore.

8. A peg board system for attachment to a wall comprising:

a panel having first and second opposed surfaces;

a plurality of tapered bores extending through said sheet, each bore presenting apertures of first and second relatively reduced diameters on said opposed surfaces of said panel;

a peg for insertion into one of said bores, each peg comprising:

a discrete resilient bulb at a distal end of said peg, said bulb having an initial normal, diameter, said diameter successively reduced upon insertion into one of said apertures of said bore and passage therethrough, said bulb returning to said normal diameter upon projection of said bulb beyond the other of said bore apertures, said bulb at said normal diameter bearing against said panel surface adjacent said other aperture;

a shank extending from said bulb, said shank having a reduced configuration similar to a tapered configuration of said bore for a friction fit relationship therein;

means at an opposed end of said shank for attachment to a device to be supported by said peg as inserted in said bore.

* * * * *

UNITED STATES PATENT AND TRADEMARK OFFICE

CERTIFICATE OF CORRECTION

PATENT NO. : 5,673,803
DATED : October 7, 1997
INVENTOR(S) : Ronald E. Burback

It is certified that error appears in the above-identified patent and that said Letters Patent is hereby corrected as shown below:

Column 1, line 5, delete "beard" and substitute --board--.

Signed and Sealed this

Twentieth Day of January, 1998

*Attest:*

Bruce Lehman

BRUCE LEHMAN

*Attesting Officer*

*Commissioner of Patents and Trademarks*